United States Patent [19]

Smithers

[11] Patent Number: 4,998,303

[45] Date of Patent: Mar. 12, 1991

[54] HEAD SUPPORT FOR SALON BASIN

[76] Inventor: Scott T. Smithers, 2277 Montgomery, Cardiff by the Sea, Calif. 92007

[21] Appl. No.: 395,984

[22] Filed: Aug. 21, 1989

[51] Int. Cl.[5] ..... A45D 44/10

[52] U.S. Cl. ..... 4/523; 4/515

[58] Field of Search ..... 4/515, 516, 517, 518, 4/519, 520, 521, 522, 523; 297/391; 5/434, 436, 437

[56] References Cited

U.S. PATENT DOCUMENTS

| | | | |
|---|---|---|---|
| 789,658 | 5/1905 | Hedstrom | 4/523 |
| 853,592 | 5/1907 | Nourse | 4/523 |
| 906,410 | 12/1908 | Greene | 4/523 |
| 3,026,537 | 3/1962 | Schnell | 4/523 |
| 3,854,148 | 12/1974 | La Rose | 4/519 |
| 3,940,336 | 6/1962 | Plank | 4/521 |
| 4,352,216 | 10/1982 | Grim | 4/523 |
| 4,546,504 | 10/1985 | Vars | 4/515 |
| 4,754,503 | 7/1988 | Martin | 4/517 |
| 4,766,620 | 8/1988 | Boyhan | 4/516 |

FOREIGN PATENT DOCUMENTS

| | | | |
|---|---|---|---|
| 340998 | 1/1931 | United Kingdom | 4/523 |

*Primary Examiner*—Henry J. Recla
*Assistant Examiner*—Glenn T. Barrett
*Attorney, Agent, or Firm*—Gregory J. Nelson

[57] ABSTRACT

A head support for supporting the head and the neck of a user in a comfortable position above a sink or basin during hair rinsing or treatment which support has a U-shaped frame with spaced-apart bendable supports which are engageable with the edge or rim of the sink. A perforate headrest plate is supported on the frame and is transversely concave. A support extends from the plate engageable against an interior wall of the sink to adjustably position the device with the frame generally horizontal. In an alternate embodiment, a detachable bonnet may be secured to the frame and placed about a portion of the head of the user.

10 Claims, 2 Drawing Sheets

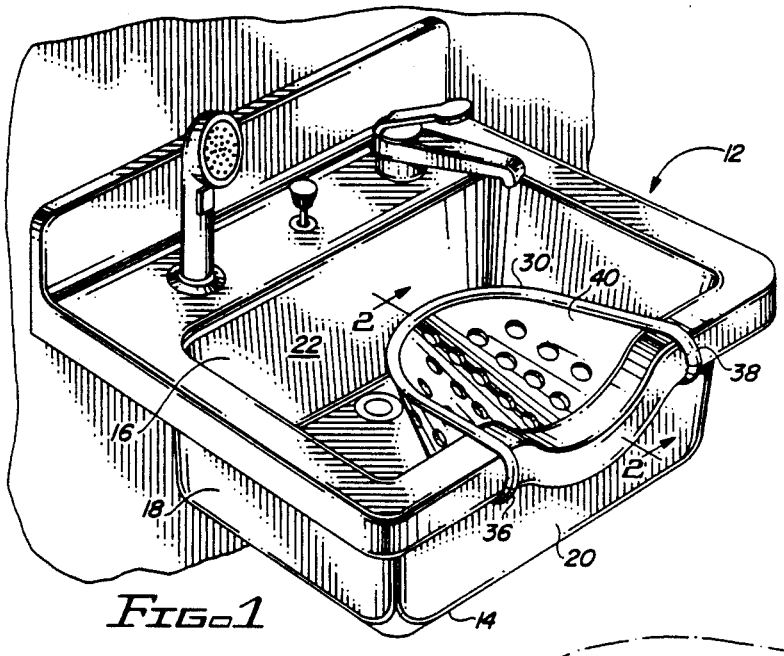
FIG. 1
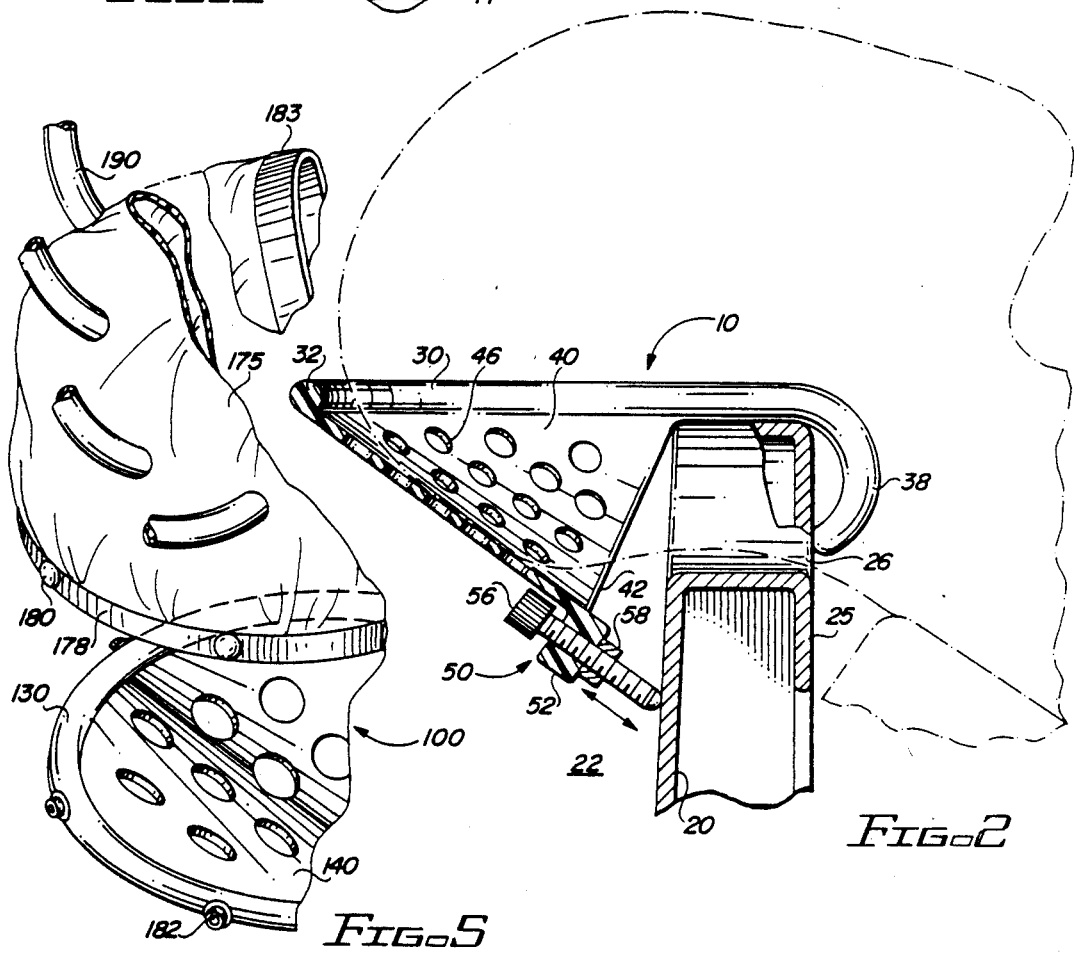
FIG. 2
FIG. 5

FIG. 3
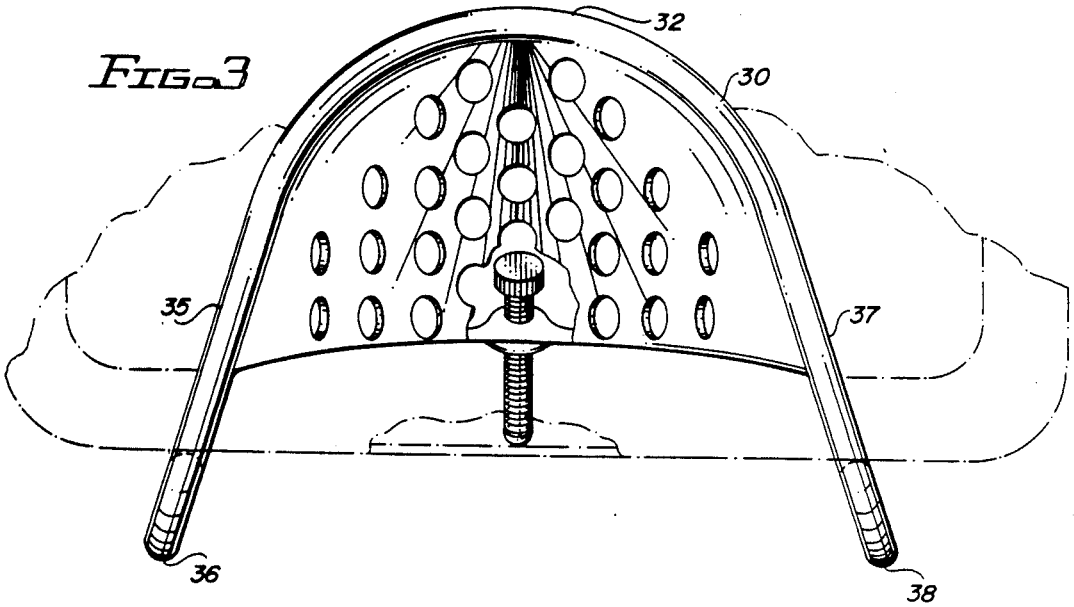
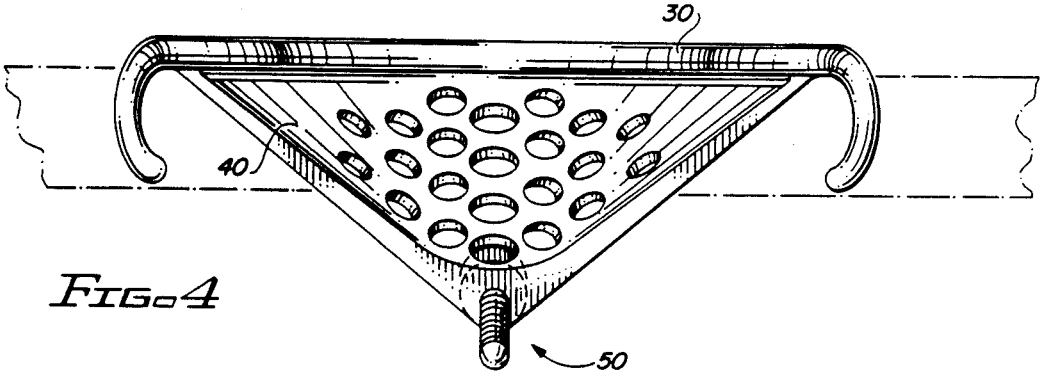
FIG. 4

HEAD SUPPORT FOR SALON BASIN

The present invention relates to a head support and more particularly to a head support for a basin or sink of the type commonly used in beauty parlors and salons for washing, rinsing and applying cosmetic treatments to a patron's hair.

Beauty parlor sinks or basins are generally configured having a front wall which defines a U-shaped depression. During the shampooing, rinsing and other treatments, the patron is positioned in a rearwardly reclining chair and the neck of the individual is placed in the U-shaped depression in the sink with the individual's head unsupported extending over the sink. Rinsing, shampooing and other hair treatments are conducted and the salon customer must use the head and neck muscles to support the head for a period of time which can be strenuous and uncomfortable for the customer. This is particularly the case when the customer is undergoing a prolonged treatment such as a permanent wave procedure which may require multiple rinsings and treatments.

Therefore, there exists a need for a head-supporting device which will effectively provide support for a person undergoing beauty salon procedures such as shampoo and rinsing. Various head supports for this purpose can be found in the prior art. U.S. Pat. No. 4,546,504 discloses a head support for a sink which comprises an elongated, perforated, flexible band of water-resistant material which has apertures near its opposite ends. The band has a length substantially less than the width dimension of the sink. The support includes a length of flexible cord which extends through the apertures in the band. Hooks for releasably securing the opposite ends of the cord to the upper edges of the sink side walls are also provided.

U.S. Pat. No. 2,516,601 shows a shampooing head rest that is positionable in a wash bowl during shampooing and washing operations. The headrest has a neck-receiving portion with a substantially flat seat which rests upon the wash bowl wall. A downwardly inclined drain portion extends at an angle from a recess which receives the neck of the person. Lobes with flanges are provided on opposite side of the neck-receiving portion to catch water and direct it downwardly. A projection or tongue engages the outside front surface of the bowl for anchoring the headrest in position.

U.S. Pat. No. 3,026,537 shows a headrest for shampooing hair which is generally U-shaped having end portions which rest or overlie a cabinet with the bight portion of the device overhanging the sink. A vertically-adjustable leg member has a suction cup on its lower end and is connected to the U-shaped support in the area of the bight.

U.S. Pat. No. 4,352,216 discloses a permanent wave headrest attachment having a foraminous panel which supports the weight of the head of the user having a suspension member such as a rigid strap hanger which engages a flange of the lavoratory sink.

While the above headrest attachments found in the prior art do serve to support the head of a person during shampooing and other salon operations, they generally have certain deficiencies and have not found wide acceptance in the salon and beauty parlor industry. Accordingly, there exists a need for a universal headrest which is usable with various lavoratory basin and sink configurations and which will effectively and comfortably support the head and neck of an individual.

Accordingly, it is an object of the present invention to provide a sink headrest which is universal and is usable with a wide variety of sink or basin configurations.

It is another object of the present invention to provide a neck and head support for use in beauty salons to relieve uncomfortable pressure on the neck and head of the user during shampooing and other salon operations which are carried out over a sink or basin.

Another object is to provide a head support of the type mentioned above which attaches easily to sinks or basins and which is easily and conveniently adjustable.

Another object of the present invention is to provide a headrest which is light weight, inexpensive, easy to install and resistant to chemicals, soaps and reagents used in shampooing, coloring and waving hair.

Briefly, the head support of the present invention is adapted to be attached to the rim of a hair rinse sink or basin and is attachele to the basin or sink to support the head of a person having his or her hair rinsed or treated in a position over the sink. The support includes a headrest in the form of a concave plate which supports the head from below. The plate has a plurality of large apertures to permit water to pass through the plate. The plate is supported on a frame having forwardly extending hooks which are adapted to attach to the rim of the sink. The hooks are bendable so they may be manually formed or shaped to snugly fit the contour of the rim.

An internally threaded boss is provided on the underside of the headrest plate and receives a threaded support member which is adjustable and which is adapted to engage the inner surface of the sink to support the device. The device may be adjusted positionally by means of the bendable hooks and the threaded support member to accommodate basins or sinks of various shapes and sizes. The concave configuration of the head supporting plate also serves to support the posterior cranial portion of the head of the user in a comfortable and natural position relieving stress on the head and neck muscles of the user.

Other features and advantages of the present invention will become more readily apparent from the following description, claims and drawings in which:

FIG. 1 is a perspective view of the headrest of the present invention attached to a basin or sink;

FIG. 2 is a sectional view taken along lines 2—2 of FIG. 1 showing the head of a user supported thereon;

FIG. 3 is a top view of the support in position on a sink;

FIG. 4 is a front view of the support in a position of use with the sink rim represented in dotted lines; and FIG. 5 is a partial perspective view of an alternate embodiment of the present invention.

Referring to the drawings wherein like reference characters designate the same or similar elements throughout the several figures, a head support is shown generally designated by the numeral 10 in association with a conventional sink or basin 12. The sink or basin 12 has a generally flat bottom 14, a rear wall 16, opposite sidewalls 18 and a front wall 20 defining interior basin 22. The front wall 12 is provided with a forwardly curved lip or flange 25 along its upper edge. A portion of the front wall defines a generally U-shaped recess 26 at an intermediate location along the lip for receiving and supporting the head and neck area of the customer during rinsings and treatments. As is normally the practice, the patron is generally seated in the reclinable chair adjacent the sink when shampooing, rinsing or other similar beauty salon treatments are performed which require application of liquids or water. The patron's chair is rearwardly reclined so that the neck of the user is received in the U-shaped recess 26 in the front wall of the sink. In the normal situation without the benefit of the head support, the patron must hold his or her head in a steady position over the sink bottom which can be very strenuous and uncomfortable particularly during a prolonged rinsing or shampooing operation. With the head support 10, the head and neck of the user are comfortably supported during rinsing and hair treatments.

The head support 10 of the present invention as shown in FIGS. 1 to 4 has a generally arcuate frame 30. The frame 30 has a curved bight portion 32 at the rear of the frame and opposite arms 35 and 37 which terminate at curved hanger members 36 and 38, respectively, at the opposite distal ends of the frame 30. The hangers are engageable with the lip or rim 25 of the front wall of the sink and are preferably spaced apart a sufficient distance to engage the rim or sink at the opposite horizontal surfaces adjacent the recess 26. The hangers 36 and 38 are manually bendable or deflectable so they may be contoured by the attendant to snugly fit the configuration of the sink rim. The hangers 36 and 38 have sufficient rigidity and strength so once bent will not yield or deflect as a result of the normal force imposed from supporting the head and neck of a patron.

Headrest plate 40 is secured to the frame 30 having a transversely extending front edge 42 extending between opposite frame arms 35 and 37 rearwardly of the hangers 36 and 38. As best seen in FIG. 2, the headrest plate inclines downwardly from the bight portion 31 to the front transverse edge 42. Edge 42 angles rearwardly providing a clearance space between the edge and the front wall of the sink for ease of installation. The headrest plate 40 is transversely concave being shallow adjacent the bight portion 31 and having the greatest depth or concavity at the front edge 42. The headrest plate 40 is foraminous having a plurality of large perforations 46 to allow water to drain through the plate.

An adjustable support member 50 is provided at the forward edge of the plate at a central position to permit the angularity of the head support with respect to the front wall of the sink to be adjusted. To this end, a boss 52 is integrally formed at a central location at the lower forward edge 42 of the plate. Boss 52 is internally threaded and receives an elongate threaded stem 54 having a head 56 which is knurled so adjustment can be easily accomplished. A locking nut 58 is in threaded engagement with the stem on the opposite side of the boss. As will be apparent, the threaded member may be axially adjusted with respect to boss 52 to position the plate properly with respect to the sink. The outer end of the stem 54 engages the inner, vertical surface of the front sink wall. When the proper adjustment is obtained, the lock nut 58 may be tightened engaging the forward surface of the boss. The adjustment member supports the majority of the weight imposed during use. In this way the weight is distributed so the entire weight is not carried by the hangers.

As used above, the relative terms such as "forward" and "rear" are used for convenience of reference. "Forward" or "front" refers to an orientation or direction toward the front wall of the sink when the device is in a position of use and "rearwardly" or "rear" refers to an orientation or direction toward the rear wall of the sink when the device is put in the position of use.

The head support of the present invention may be fabricated from various materials. For example, the headrest plate and frame may be fabricated from a suitable metal and coated with a chemically-resistant plastic or rubber material. The device of the present invention lends itself particularly to fabrication by plastic molding techniques and materials such as ABS, styrene or PVC are well suited for this purpose having adequate strength, chemical resistance and aesthetic appeal.

The head support 10 is extremely lightweight and is characterized by simplicity of construction, convenience of use and efficiency and economy of manufacture. Use of the present invention substantially eliminates or alleviates the discomfort involved during procedures such as rinsing, shampooing or otherwise treating hair as is normally practiced in beauty salons.

In use, the head support 10 is positioned with the bendable hangers 36 and 38 engaging the sink rim or flange 25 at opposite sides of the recess 26. The bendable hangers 32 and 34 can be manually formed to the configuration of the sink, rim or flange for the best fit. Frame 30 extends rearwardly and generally it is desirable to position the frame in a generally horizontal position. Accordingly, elongated stem 54 is adjusted with respect to the threaded boss 52 to position and support the frame in the proper orientation. When the adjustment is completed, the lock nut 58 is tightened and the support is properly suspended in place with the headrest plate 40 above the sink or basin. The patron is then allowed to rearwardly recline with the patron's neck engaging the U-shaped recess in the sink and the occipital portion of the patron's head will engage the headrest plate 40 as seen in FIG. 2. The attendant can then proceed with the hair treatment such as shampooing. Liquid run-off will flow through the apertures 46 in the headrest plate 40 and also down along the plate 40 flowing from the lower forward edge 42 of the plate into the subjacent sink 22. The head support is portable and compatible with most standard beauty salon sinks and basins and as described above can easily be installed and removed if necessary. During the hair treatment and process, the head and neck of the user is comfortably supported in a natural position due to the rearwardly, upwardly inclined orientation of the support plate. Further, the support plate is inclined and is transversely concave, corresponding to the shape of the patron's head so that the head will be comfortably cradled.

FIG. 5 shows an alternate embodiment of the present invention which is generally designated by the numeral 100. The perforate head support plate is generally constructed as has been described above having a generally arcuate frame 130 terminating at bendable hangers at the distal ends of the frame. A transversely concave and rearwardly, upwardly inclined perforate headrest 140 is attached to the frame. The position of the device may be adjusted by threaded adjustment member axially adjustable with respect to a boss member on the underside of the plate. The headrest inclines rearwardly and is transversely concave to receive the rear of the head of the user. The above features are substantially as have been described with respect to FIGS. 1 to 3 and detailed description is not believed necessary.

In the embodiment 100, the frame 130 is adapted to receive a bonnet 175 which is preferably a flexible, plastic material. The bonnet 175 has a lower edge 178 which generally conforms to a portion of the U-shaped frame 130 having fastening members 180 thereon. Fastening members 180 may be cooperative and secured to fastening members 182 around the peripheral edge of the frame. With the patron's head comfortably resting on the support, the bonnet may be attached to the frame over the upper part of the head of the patron using cooperative fasteners 180, 182. In this position, a front edge of the bonnet extends over the forehead area of the user and may be elasticized at elastic band 183 for a snug fit. This will prevent chemicals applied to the patron's hair from running into the eyes of the patron.

With the bonnet in place, various hair treatments can be applied and for this purpose, one or more tubes 190 extend from the bonnet through which hair treatment conditioners, dyes, warm air and the like may be applied to the hair of the user. Since the bonnet is fastened along its lower edge to the frame, loss of the treating dye or chemical is minimized and the elasticized fit of the bonnet prevents or minimizes introduction of such chemicals onto the face or into the eyes of the patron.

It will be obvious to those skilled in the art to make various changes, alterations and modifications to the invention described herein. To the extent these various modifications, changes and alterations do not depart from the spirit and scope of the appended claims, they are intended to be encompassed therein.

I claim:

1. A head support for a person's head which support is detachably securable to a sink having a vertical wall with an upper edge, said head support comprising:

(a) a frame having a pair of transversely spaced-apart hanger members adapted to engage the upper sink edge;

(b) a headrest plate supported on said frame in a position of use over said sink, said headrest plate being generally transversely concave adapted to engage and support the back of the person's head, said headrest plate being downwardly and forwardly inclined from said frame to a forward edge, at least a portion of said forward edge being spaced from said sink wall in a position of use; and support means associated with said plate and engageable with and adjustable with respect to an inside of said vertical sink wall to support said frame in a generally horizontal position to at least partially support said head support at said sink wall.

2. The head support of claim 1 wherein said hangers are generally normally hook-shaped and said frame is generally arcuate.

3. The head support of claim 1 wherein said headrest plate is fabricated from a chemically-resistant plastic material.

4. The head support of claim 1 wherein said headrest plate is perforated.

5. The head support of claim 1 wherein said support means comprise an internally threaded boss secured to said plate and an axially adjustable screw means engaging said internally threaded boss means.

6. The head support of claim 5 further including locking means associated with said screw means.

7. The head support of claim 1 further including a flexible bonnet and cooperative fastener means carried on said bonnet and said frame.

8. The head support of claim 1 wherein said flexible bonnet includes elasticized section engageable with at least a portion of the head of the user.

9. The head support of claim 8 further including tube means connected to said bonnet for applying liquids to the head of the user.

10. The head support of claim 1 wherein said hanger members are manually bendable to conform to a desired configuration.

* * * * *